United States Patent [19]

Harbauer

[11] 4,318,065

[45] Mar. 2, 1982

[54] MEANS FOR ACTUATING ELECTRO-MAGNETIC SWITCHGEAR

[75] Inventor: Werner Harbauer, Schwandorf, Fed. Rep. of Germany

[73] Assignee: Siemens Aktiengesellschaft, Munich, Fed. Rep. of Germany

[21] Appl. No.: 212,217

[22] Filed: Dec. 2, 1980

[30] Foreign Application Priority Data

Dec. 5, 1979 [DE] Fed. Rep. of Germany ..... 2948959

[51] Int. Cl.[3] ..... H01H 73/12

[52] U.S. Cl. ..... 335/17; 200/308

[58] Field of Search ..... 335/17, 18; 200/308

[56] References Cited

U.S. PATENT DOCUMENTS

| | | | |
|---|---|---|---|
| 2,534,107 | 12/1950 | Curzon | 335/17 X |
| 3,816,827 | 6/1974 | Lynn | 335/17 X |
| 3,852,556 | 12/1974 | Kane et al. | 335/17 X |

*Primary Examiner*—George Harris

*Attorney, Agent, or Firm*—Kenyon & Kenyon

[57] ABSTRACT

The invention relates to a circuit arrangement for actuating an electromagnetic switchgear comprising a switch position indicator, by means of a leading contact that closes a circuit to supply current to an actuating coil of an electromagnet. Main contacts of the switchgear close just after the leading contact. The electromagnet holds all of the contacts in their actuated positions until current through its coil is interrupted.

3 Claims, 3 Drawing Figures

MEANS FOR ACTUATING ELECTRO-MAGNETIC SWITCHGEAR

BACKGROUND OF THE INVENTION

The invention relates to a circuit arrangement for actuating electromagnetic switchgear, which comprises a switch position indicator, by means of an "on" key for the actuating coil.

In a known arrangement of an electromagnetic switching device German Pat. No. (DE-PS 592 266) the "on" key is the auxiliary contact which can be brought into the "on" position independent of the "off" position of the electromagnetic switch yoke and closes the circuit for holding the electromagnetic switch, whereby the auxiliary contact is held by the electromatic switch yoke following without mechanical action into the actuated position. In this switching device separate holding means for the main and auxiliary contacts are provided, so that a fixed sequence of operation of the auxiliary contacts and main contacts cannot be ensured.

Further, an arrangement is known for switching on of a load (German non-prosecuted application DE-OS No. 27 32 914) in which switching on of the electromagnetic switch contacts is effected mechanically and the circuit for the energizing coil is only completed on closing of the electromagnetic switch contacts. Here, the switch disposed in the circuit of the energizing coil is mechanically coupled with the electromagnetic switch contacts and the switch itself serves for switching on the load. Voltage is not, however, applied to the energizing coil until the main contacts are closed.

SUMMARY OF THE INVENTION

It is an object of the present invention to provide an electromagnetic switching device which, with little expenditure for wiring and materials, permits operation by means of the switch position indicator and which reliably prevents switching on of the electromagnetic switch when safety contacts connected in series in advance of the auxiliary contact are opened by monitoring or protective devices. This aim is achieved in a simple manner in that the switch position indicator connected with the yoke and carrying all moving contacts is of such construction and arranged in such a manner that only the make contact forming the "on" key is closed at maximum operating travel of the switch position indicator. If the switching device is accommodated in a housing, it is advantageous to provide an extension plunger operating the switch position indicator.

DETAILED DESCRIPTION OF THE INVENTION

Figure 1:
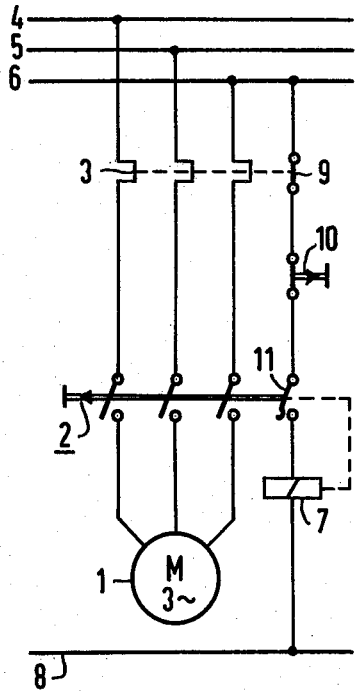
FIG. 1 shows one embodiment of switchgear actuating means according to the invention.

According to the circuit arrangement shown in FIG. 1, a three-phase motor 1 is connected via an electromagnetic switchgear 2 and an overload tripping device 3 to phase lines 4, 5 and 6 of a three-phase network. One side of an actuating coil 7 of the electromagnetic switchgear 2 is connected to a ground-potential conductor (MP) 8 and the other, via a break contact 9 of the overload tripping device 3, an "off" key 10, and a make contact 11 of the electromagnetic switchgear 2, to the phase line 6. The coil 7, the contact 11, the key 10 and the contact 9 form a series control circuit.

Figure 3:
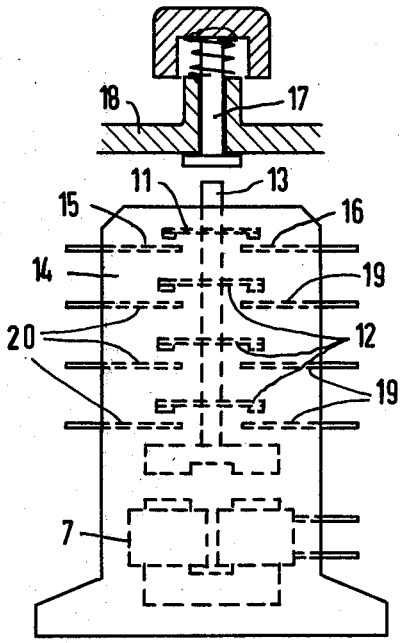
FIG. 3 illustrates the mechanical design for implementing the circuit in FIG. 1 or FIG. 2.

The make contact 11 is shown in FIG. 3 as a leading contact because it closes before the main contacts 12 close if the switch position indicator 13 is operated, and it may be considered an "on" key. The switch position indicator 13, which can be part of the contact bridge support of the electromagnetic switchgear, extends beyond the confines of a housing 14 of the electromagnetic switchgear only to the extent necessary for one contact bridge to come into contact with the fixed contacts 15 and 16 without the aid of tools or other accessories. The contact bridge with the fixed contacts 15 and 16 forms the make contact 11. The main contacts 12 are likewise indicated dashed in FIG. 3 and are arranged below the leading make contact 11. The switch position indicator 13 can be actuated by an extension plunger 17, which is movably arranged in the wall 18 of an additional housing. The actuating base of the extension plunger 17 can have an area so large that pushing the switch position indicator 13 below the contour of the housing 14 is automatically prevented. The same limitation of movement can be achieved by hollowing out the base of the extension plunger 17.

Figure 2:
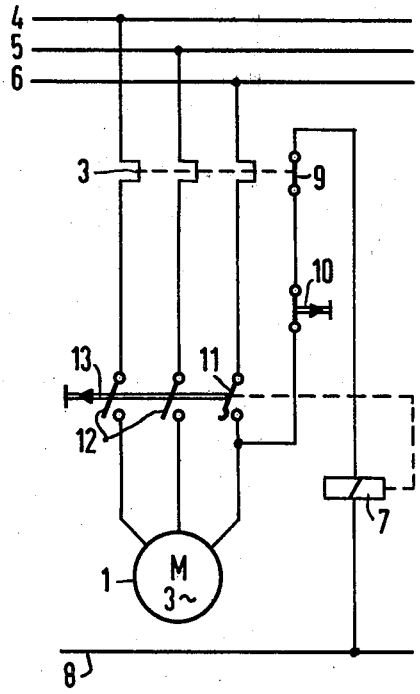
FIG. 2 shows another embodiment of switchgear actuating means according to the invention.

In the circuit in FIG. 2, the leading contact 11 is also one of the main contacts. One lead of the coil 7 is connected by way of the break contact 9 of the overload tripping device 3, the "off" key 10, the leading make contact 11 and the overload tripping device 3, itself, to the phase line 6. The other lead from the coil 7 is connected to the MP conductor 8. The circuit shown here can be used particularly for smaller power ratings, for which a 2-phase disconnect is permissible. The embodiment in FIG. 2 has the additional advantage of saving an auxiliary contact.

If the extension plunger 17 or the switch position indicator 13 is pushed in, the leading make contact 11 is closed. The main contacts 12 are still fully open at this instant, but current is applied to the actuating coil 7 via a series control circuit that also includes the overload tripping device 3, the make contact 11, the "off" key 10 and the break contact 9 and is connected between the phase line 6 and the MP-conductor 8. The current that flows through the actuating coil, takes care of switching on the other parts of the electromagnetic switchgear 2. By manually pushing the movable parts of the electromagnetic switchgear, shown dashed in FIG. 2, by means of the switch position indicator 13, the static friction is overcome, so that the magnetic system of the electromagnetic switchgear can pull the main contacts 12 to their actuated positions more easily, i.e., with less power. Therefore, a smaller electromagnet is sufficient. By spacing the movable part of the contact 11 slightly closer to the associated fixed contact parts 15 and 16 than the movable parts of the following main contacts are to their associated fixed contact parts 19 and 20, the range of travel of the position indicator 13 may be arranged so that only the leading contact 11 can by moved into its actuated position by manual operation of the position indicator. The additional small movement of the position indicator necessary to bring the main contacts 12 into their actuated positions is achieved by the electromagnetic force due to current flowing in the coil 7.

If at the instant of closing, the break contact 9, which is controlled in the present case by the overload tripping device 3, or other safety contacts connected in the series control circuit, are operated by monitoring or safety devices and are not closed, the electromagnetic switchgear cannot be switched on by actuating the switch position indicator 13. Thus, safe and proper disconnection with corresponding trip-free release is assured in the event of a disturbance.

The circuit arrangement according to the invention, including the design, the expenditure for wiring, and material to make additional keys and contacts can be manufactured substantially less expensively than in prior known arrangements, and this can be achieved without making the equipment less safe.

What is claimed is:

1. Electromagnetic switchgear actuation means comprising:

a switch position indicator comprising magnetic means;

an electromagnet comprising a coil;

a leading contact comprising a first fixed part and a first movable part, the leading contact being connected in series with the electromagnet coil and a source of current and the movable part of the leading contact being mechanically connected to the switch position indicator to be moved thereby to actuated position in contact with the first fixed part to connect the coil to the source of current to energize the electromagnet and hold the leading contact closed;

at least one following main contact comprising a second fixed part and a second movable part connected to the switch position indicator to be moved thereby to an actuated position in contact with the second fixed part following the movement of the leading contact into the actuated position thereof, wherein the switch position indicator connected with the yoke and carrying all the moving contacts is of such construction and arranged in such a manner that only the leading contact forming the "on" key is closed on maximum operating travel of said switch position indicator.

2. Device as defined in claim 1 in which an extension plunger operating the switch position indicator is provided.

3. The invention as defined in claim 1 in which the range of travel of the position indicator in response to mechanical pressure is at least great enough to move the first movable part of the leading contact into connection with the first fixed part but is less than the distance required to move the second movable part main contact into connection with the second fixed part and the electromagnet is sufficiently powerful to move the position indicator an additional amount sufficient to bring the second movable part of the main contact into connection with the second fixed part.

* * * * *